US006137823A

United States Patent [19]

Johnson et al.

[11] Patent Number: 6,137,823

[45] Date of Patent: Oct. 24, 2000

[54] BI-METAL PANEL FOR ELECTRIC ARC FURNACE

[75] Inventors: Eric N. Johnson, Clinton, Iowa; Roger E. Johnson, Fulton, Ill.; Craig S. Johnson, Clinton, Iowa

[73] Assignee: J. T. Cullen Co., Inc., Fulton, Ill.

[21] Appl. No.: 09/237,366

[22] Filed: Jan. 26, 1999

[51] Int. Cl.[7] ..... F27D 1/12

[52] U.S. Cl. ..... 373/76; 373/71

[58] Field of Search ..... 373/71–76, 107; 122/6 A, 6 C

[56] References Cited

U.S. PATENT DOCUMENTS

| | | | |
|---|---|---|---|
| 4,119,792 | 10/1978 | Elsner et al. | 373/76 |
| 4,207,060 | 6/1980 | Zangs | 432/77 |
| 4,216,348 | 8/1980 | Greenberger | 373/74 |
| 4,453,253 | 6/1984 | Lauria et al. | 373/74 |
| 4,458,351 | 7/1984 | Richards | 373/76 |
| 4,637,034 | 1/1987 | Grageda | 373/76 |
| 4,903,640 | 2/1990 | Howard | 122/6 A |
| 5,197,080 | 3/1993 | Johnson et al. | 373/76 |
| 5,289,495 | 2/1994 | Johnson | 373/74 |
| 5,426,664 | 6/1995 | Grove | 373/76 |
| 5,787,109 | 7/1998 | Stenkvist | 373/107 |

*Primary Examiner*—Tu Ba Hoang
*Attorney, Agent, or Firm*—Zarley, McKee, Thomte, Voorhees & Sease

[57] ABSTRACT

An electric arc furnace comprises a bottom, a roof and a side wall. The side wall is formed from a plurality of bimetal panels each having an inner copper face and an outer steel face. The roof may be formed with similar bi-metal panels. The hollow panels include internal baffles to define channels through which cooling water flows. The copper face is smooth and free of welds so as to maximize thermal heat transfer by the panels. The copper face enhances thermal efficiency and minimizes maintenance requirements of the panels, while the steel face reduces manufacturing costs of the panels.

18 Claims, 3 Drawing Sheets

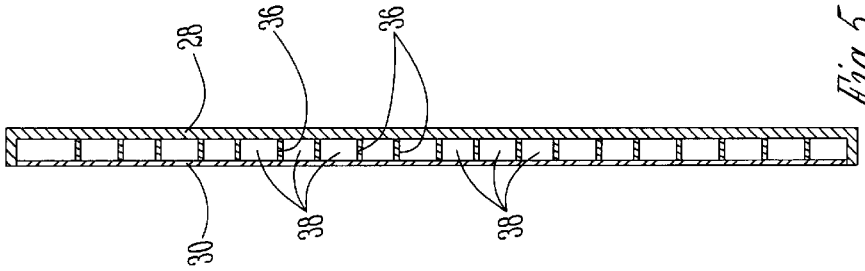
Fig. 5
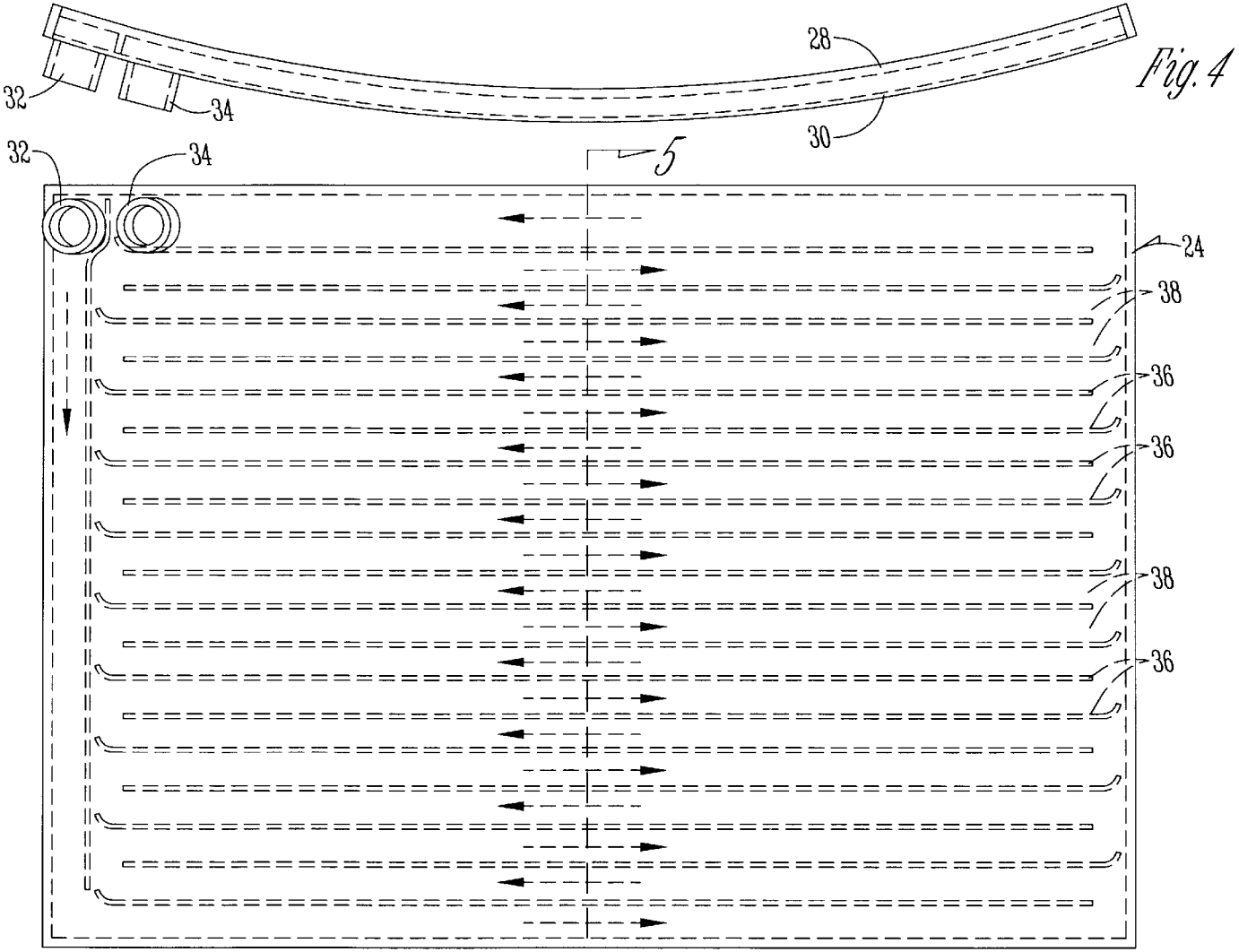
Fig. 4
Fig. 3

BI-METAL PANEL FOR ELECTRIC ARC FURNACE

BACKGROUND OF THE INVENTION

Electric arc smelting furnaces are used to manufacture steel from scrap metal. The scrap metal is heated to a melting temperature, such that the molten steel can be collected and processed for further use.

The melting process imposes thermal, chemical and mechanical stresses on the furnace. Consequently, the furnaces must have structural integrity to ensure safe operation and production. Frequent maintenance schedules must be maintained on the furnaces, thereby making recycling of steel very costly.

In an effort to alleviate the stresses, and to lower the operating cost of recycling steel, liquid cooling systems have been installed on electric arc furnaces. One such cooling system is disclosed in U.S. Pat. No. 4,207,060 which utilizes a series of cooling pipe coils. Generally, the coils are formed from adjacent pipe sections with a curved end cap welded to the ends of adjacent pipes to form a serpentine path for a liquid coolant flowing through the coils. This coolant is forced through the pipes under pressure to maximize heat transfer.

Another cooling system is disclosed in U.S. Pat. No. 4,119,792 which utilizes cooling boxes, rather than coiled tubes. The cooling boxes may include internal channels to direct cooling water from the bottom to the top of the coiling box.

The cooling coils and cooling boxes of the prior art are typically manufactured of steel or copper. While copper has better heat transfer properties than steel, copper is much more expensive than steel. Copper also does not have the structural strength of steel. Furthermore, cast steel panels are subject to mechanical-thermal stresses due to uneven cooling across the face of the panel. Coiled steel tubes or pipes are subject to heat stress cracking, particularly at the bends or end caps of the coils.

Electric arc furnaces are being used at hotter temperatures and faster production times, which increases the heat cycle time, thereby increasing failures from stress in both coiled tubes and cast panels. While copper resists such stresses is better than steel, the cost of manufacturing such copper pipes and panels is expensive, compared to the cost of steel pipes and panels.

Accordingly, a primary objective of the present invention is the provision of a bi-metal panel having an inner copper face and an outer steel face for use in an electric arc furnace.

Another objective of the present invention is the provision of an electric arc furnace cooling panel having a bi-metal construction utilizing copper only on the inner heat transfer surface of the panel.

A further objective of the present invention is the provision of an improved cooling panel for an electric arc furnace having a smooth, thin, inner copper wall.

A further objective of the present invention is the provision of an improved cooling panel for an electric arc furnace which produces a uniform slag layer, thereby reducing the heat flux required to be removed from the furnace by the panel.

Another objective of the present invention is the provision of an improved cooling panel for an electric arc furnace which is economical to manufacture, thermally efficient and effective, and having minimal maintenance requirements.

A further objective of the present invention is the provision of an electric arc furnace cooling panel which is resistant to heat related stresses.

Another objective of the present is the provision of a cooling panel for an electric arc furnace that can be used in the side wall of the furnace or in the roof of the furnace.

These and other objectives become apparent from the following description of the invention.

SUMMARY OF THE INVENTION

The cooling panel of the present invention is designed for use in an electric arc furnace. The panel includes an inner copper plate and an outer steel plate which are joined together to form a hollow bi-metal panel. Internal baffles or walls are formed in the panel to define channels through which cooling water flows. The inner copper plate is thin, smooth and free from welds so as to optimize heat transfer during the operation of the furnace. A plurality of the bi-metal panels can be used in the side walls of the furnace or in the roof of the furnace. The use of copper on the inner face of the panels maximizes the thermal efficiency of the panels and reduces the maintenance requirements of the panel, while the use of steel on the outer face of the panels minimizes the manufacturing cost.

BRIEF DESCRIPTION OF THE DRAWINGS

FIG. 3 is an elevational view of a wall panel according to the present invention.

FIG. 4 is a top view of the wall panel of the present invention.

FIG. 5 is a sectional view taken along lines 5—5 of FIG. 3.

DETAILED DESCRIPTION OF THE DRAWINGS

Figure 1:
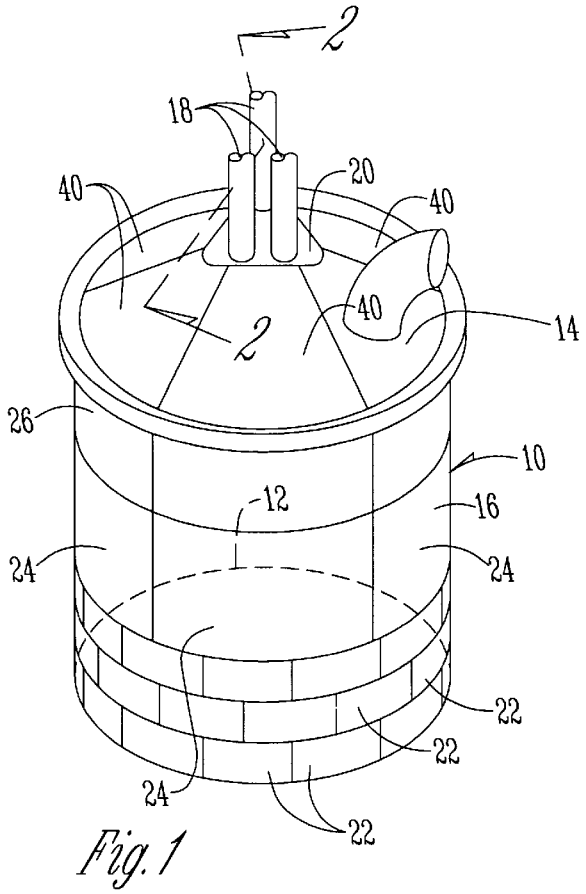
FIG. 1 is a perspective view of an electric arc furnace having the improved cooling panels of the present invention.

The reference numeral 10 generally designates an electric arc furnace having a bottom wall 12, a top wall or roof 14, and a side wall 16. Electrodes 18 extend through an opening 20 in the roof 14.

The side wall 16 of the furnace 10 includes a lower section formed of refractory brick 22, a middle section of panels 24 in accordance with the present invention, and an upper section of pipe coils 26. The refractory bricks 22 are conventional and do not form a part of the present invention. The pipe coils 26 may be formed in accordance with applicant's U.S. Pat. No. 5,289,495, and extend 180° or 360°. The pipe coils 26 are used in the upper section of the sidewall, where temperatures are cooler as compared to the middle section of the sidewall. Due to the lower temperatures, the coils 26 do not need replacement as frequently as prior art coils that are located in the middle section of the sidewall.

The panels 24 which form a part of the side wall 16 of the furnace 10 each have a bi-metal construction of copper and steel. As best seen in FIGS. 4 and 5, each panel 24 includes an inner copper plate 28 which defines the inner face of the panel 24, and an outer steel plate 30 which defines the outer face of the panel 24. The copper plate 28 and the steel plate 30 are welded together or otherwise joined, to form the hollow panel 24. A water inlet line 32 and a water outlet 34 are provided on the rear face of the steel plate 30. A plurality of baffles or internal walls 36 are formed within the panel 24 so as to direct the flow of water through the panel along the channels 38 defined by the baffles 36, from the inlet line 32 to the outlet line 34, as indicated by the arrows in FIG. 3.

Figure 2:
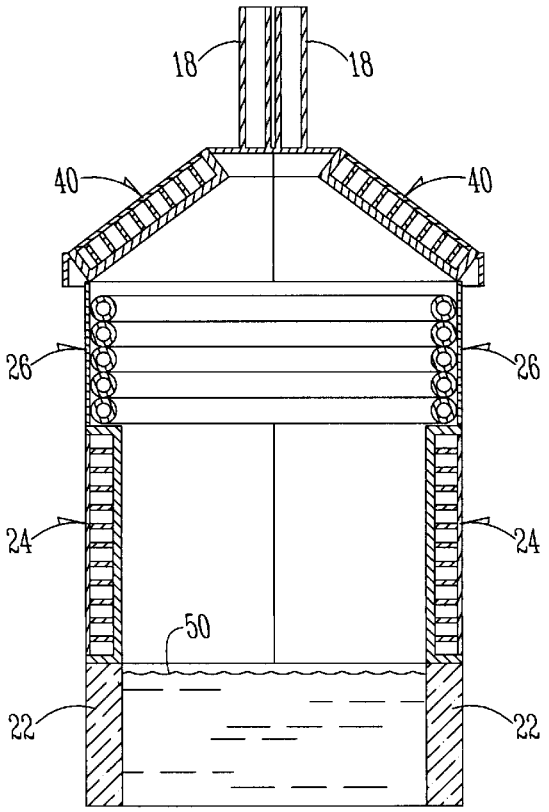
FIG. 2 is a sectional view of the furnace taken along lines 2—2 of FIG. 1.
Figure 6:
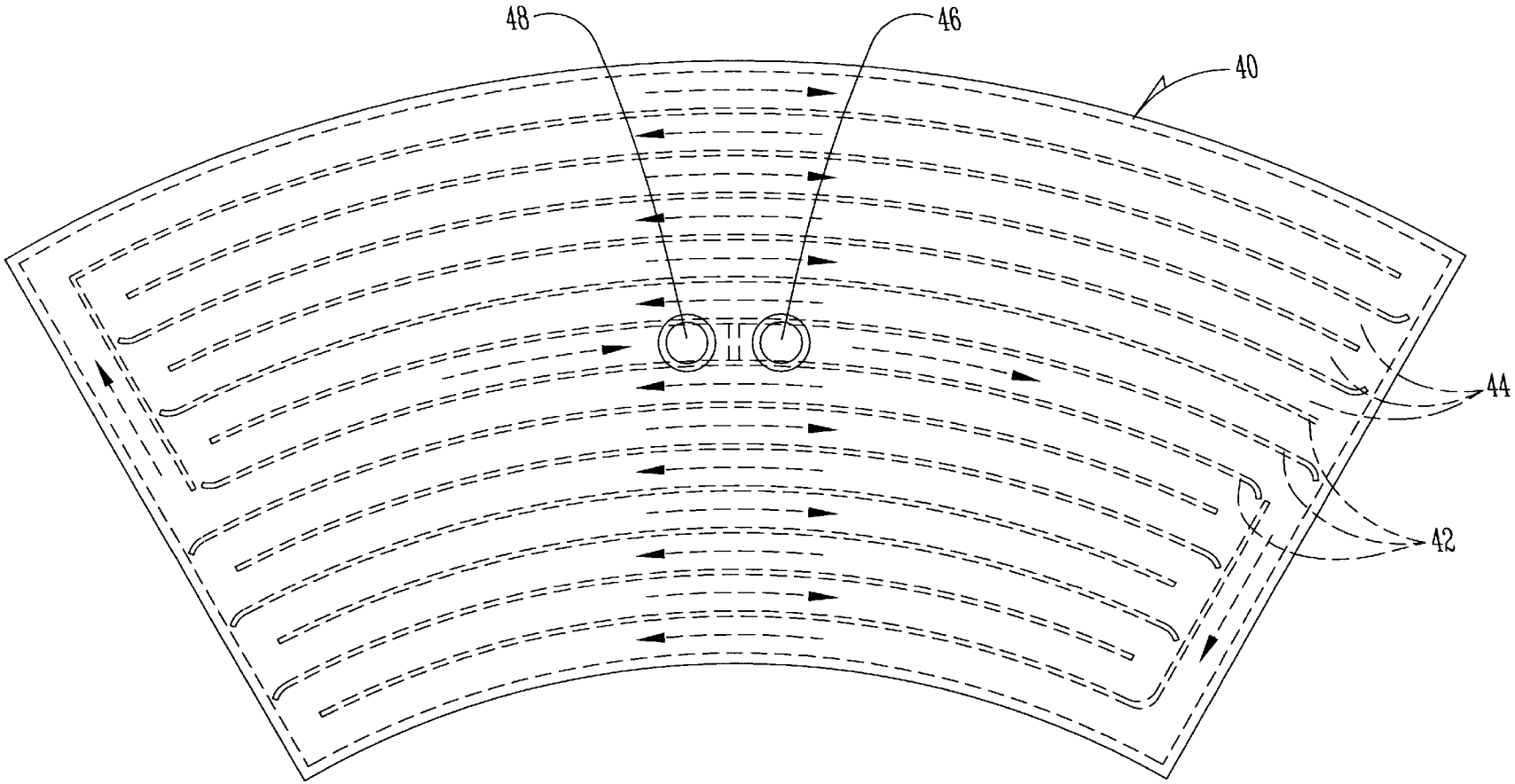
FIG. 6 is an elevational view of a roof panel according to the present invention.

As seen in FIGS. 2 and 6, the roof is also constructed of a plurality bi-metal panels 40 having a copper and steel construction similar to that of wall panels 24. The roof panels 40 also have internal baffles 42 forming channels 44 through which cooling water flows from an inlet 46 to an outlet 48. If desired, the panels 40 may be used in the central part of the roof where the temperature is the hottest, with cooling coils extending around the outer perimeter of the roof where the temperature is cooler. Such outer cooling coils can extend 180° or 360° as described in Applicant's U.S. Pat. No. 5,289,495.

The panels 24 and 40 have a curved radius, preferably between 5°–40°. The wall panel 24 has a generally rectangular perimeter while the roof panel 40 has a generally trapezoidal or pie-shaped perimeter.

Preferably, the copper plate 28 of the wall panels 24 and the roof panels 40 is approximately ⅜–½ inch thick. The copper plate 28 has a smooth surface and preferably is free from welds so as to avoid stress points, otherwise associated with welded joints, thereby minimizing failure from stress cracked propagation. As an option, conventional slag anchors can be provided on the copper plate 28, if desired.

The bi-metal construction of the panels 24, 40 permits relatively expensive copper to be used only on the heat transfer inner face of the panels, with less expensive steel being used on the out face. This smooth, thin copper plate 28 allows uniform and efficient heat transfer, thus generating a more uniform slag protection layer. The uniform slag layer reduces the heat flux required to be removed from the furnace, thus reducing the water requirements of the panels. The resulting higher water cooling efficiency greatly reduces the maintenance costs to operate the arc furnace having the bimetal panels of the present invention. The bi-metal construction of the panels thus provides a panel which is less costly than 100 k copper panels or coils, with improved thermal properties, as compared to 100% steel panels or coils.

The copper plate 28 expands uniformly in response to the heat cycles of the furnace, and therefore is resistant to heat stress cracks typically found in coiled pipes. The uniform cooling across the face of the copper plate 28 also produces a resistance to mechanical-thermal stress typically associated with prior art cast panels. The panels 24 and 40 are removable from the furnace 10 if required for repair, maintenance or replacement. The upper pipe coils 26 normally do not wear or burn out, thus the construction of the furnace 10 minimizes maintenance and repair costs by using the removable panels 24 and 40. Thus, the upper portion of the side wall 16 does not have to be discarded with the middle portion of the side wall 16 when the middle portion wears out, as in the prior art.

Whereas the inventions has been shown and described in connection with the preferred embodiment thereof, it will be understood that many modifications, substitutes and additions may be made which are within the intended broad scope of the appended claims. There is therefore been shown and described an improved cooling panel for an electric arc smelting furnace which accomplishes at least all of the above stated objects.

What is claimed is:

1. A cooling panel for an electric arc furnace, comprising:

an inner copper plate;

an outer steel plate;

the inner and outer plates being joined together to form a hollow bi-metal panel through which water is flowable; and internal walls extending between the inner and outer plates to form a serpentine channel through which the water is flowable.

2. The cooling panel of claim 1 wherein the copper plate has an inwardly facing surface which is free from welds.

3. The cooling panel of claim 1 wherein the copper plate is smooth.

4. The cooling panel of claim 1 wherein the inner plate has a perimeter edge and the outer plate has a perimeter lip in mating engagement with the perimeter edge of the inner plate to allow heat transfer from the perimeter edge to the lip.

5. The cooling panel of claim 1 wherein the copper and steel plates are curved.

6. The cooling panel of claim 1 wherein the internal walls are welded to the inner and outer plates to provide a metallic bond therebetween.

7. The cooling panel of claim 1 wherein the panel has a rectangular perimeter.

8. The cooling panel of claim 1 wherein the panel has a trapezoidal perimeter.

9. The cooling panel of claim 1 wherein the panel has a curvature extending 5°–40°.

10. The cooling panel of claim 1 wherein the panel is a wall panel.

11. The cooling panel of claim 1 wherein the panel is a roof panel.

12. An electric arc furnace, comprising:

a bottom;

a roof; and a side wall;

the side wall being formed of a plurality of bi-metal panels each having an inner copper face and an outer steel face; and a serpentine channel formed between the panels of the sidewall through which water is flowable.

13. The furnace of claim 12 with the roof includes a plurality of bi-metal panels each having an inner copper face and an outer steel face.

14. The electric arc furnace of claim 12 wherein the steel face engages a perimeter edge of the copper face to enhance heat transfer between the plates.

15. The furnace of claim 12 with the copper face is free of welds.

16. The furnace of claim 12 with the copper face is smooth.

17. The furnace of claim 12 with the panels are curved.

18. The electric arc furnace of claim 12 wherein the channel is formed by internal walls welded between the copper and steel faces so as to provide a metallic bond with enhanced heat transfer between the copper and steel faces.

* * * * *